US008525668B1

(12) United States Patent
Alouani et al.

(10) Patent No.: US 8,525,668 B1
(45) Date of Patent: Sep. 3, 2013

(54) DRIVER MONITORING APPARATUS AND METHOD

(75) Inventors: Ali T. Alouani, Cookeville, TN (US); Timothy R. Cook, Cookeville, TN (US)

(73) Assignee: Eagle Engineering, LLC, Cookeville, TN (US)

( * ) Notice: Subject to any disclaimer, the term of this patent is extended or adjusted under 35 U.S.C. 154(b) by 350 days.

(21) Appl. No.: 13/030,214

(22) Filed: Feb. 18, 2011

(51) Int. Cl.
*G08B 1/08* (2006.01)

(52) U.S. Cl.
USPC ..... 340/539.13; 340/426.12; 340/573.4

(58) Field of Classification Search
USPC ..... 340/539.13, 426.12, 539.31, 573.4; 180/287; 379/38; 701/36
See application file for complete search history.

(56) References Cited

U.S. PATENT DOCUMENTS

| | | | | |
|---|---|---|---|---|
| 5,568,119 | A * | 10/1996 | Schipper et al. | 340/573.4 |
| 5,892,454 | A * | 4/1999 | Schipper et al. | 340/573.4 |
| 5,982,281 | A * | 11/1999 | Layson, Jr. | 340/539.13 |
| 6,100,806 | A * | 8/2000 | Gaukel | 340/573.4 |
| 7,209,808 | B2 * | 4/2007 | Chase et al. | 340/426.12 |

* cited by examiner

*Primary Examiner* — John A Tweel, Jr.
(74) *Attorney, Agent, or Firm* — Stephen J. Stark; Miller & Martin PLLC

(57) ABSTRACT

A monitoring device and method is utilized to monitor certain individuals. A processor receives input from at least one if not a plurality of sensors. In preferred embodiments, if multiple sensors reach certain milestones relative to certain limits, an alarm condition is provided to alert a predetermined recipient of the alarm condition, such as the authorities in the case of a person going above a certain speed limit and moving at least one of his feet to correspond to braking and/or accelerating events. Another sensor such as near the wrist of an individual could be utilized to coordinate with directional headings of the individual to create a condition appearing to be steering of a car wheel.

19 Claims, 3 Drawing Sheets

DRIVER MONITORING APPARATUS AND METHOD

FIELD OF THE INVENTION

The present invention relates to a method and apparatus for monitoring an individual and more particularly for identifying either when a particular individual is driving a vehicle such as an individual required not to drive for a particular reason or when the individual is outside of a geographic limit such as monitoring an individual under house arrest.

BACKGROUND OF THE INVENTION

There are many reasons that result in authorities suspending someone's driver license. These activities may include driving under the influence (DUI), reckless driving, multiple traffic violations, or other infraction(s) or regulation violation(s). Unfortunately, many people with revoked or suspended driver licenses continue to drive and pose a potential danger to the public.

Currently, the only technology known by the applicant that keeps unlawful drivers from driving is the ignition interlock systems. See www.ignitioninterlockdevice.org describing typical prior art devices. For drivers with DUI histories and having vehicles equipped with interlock devices, he/she has to pass an alcohol test by blowing air in a device that is coupled to the ignition. One problem with this technology is that DUI offenders can simply drive someone else's car while being intoxicated. Another problem is the user could have someone else blow in the device. In addition, such technology will not detect or hinder people having revoked driver licenses for violations other than alcohol related violations.

Accordingly, there exists a need for an improved driver monitoring device that can identify if an individual is likely driving a vehicle.

There also exists a need to monitor individuals such as those under house arrest or having other needs for which monitoring would be desirable.

SUMMARY OF THE INVENTION

It is an object of the present invention to provide various embodiments of improved individual monitors and methods of their use.

It is the present object of at least some embodiments of the present invention to provide an improved monitoring device which may alert authorities and/or others if an individual is likely to be driving a vehicle.

It is another object of at least some embodiments of the present invention to provide a device which receives data from at least one if not a plurality or array of sensors related to the speed, acceleration, and/or position of a monitored individual such as with GPS data and utilizes at least one processor to ascertain whether or not the individual is moving at a predetermined speed such as 10 MPH or other predetermined limit, and for some embodiments whether other indications create a strong likelihood the individual is driving rather than riding.

When a person drives a vehicle, he or she normally accelerates and decelerates (deceleration is accelerating negatively and the terms are synonymously utilized herein) with his or her foot on the accelerator pedal or brake pedal and steers the vehicle with the hands. The spirit of at least some embodiments of this invention is to use an array, (i.e., at least two) sensors to monitor the motion of the feet, ankles and/or legs and/or hands (i.e., extremities) wrists and/or arms of a person and correlate such information with the speed and/or orientation of the vehicle to determine with a relative high degree of certainty if a person is driving a vehicle.

The monitor embodiments that perform determination of the motion may include a stand alone system made up of an integrated array of sensors, a data acquisition system, a central processing unit, and a method for information processing and decision making. The system preferably uses ground position system (GPS) unit to provide at least one of position direction and speed information. The system may also use a communications network such as a two-way cellular, Wi-Fi communication or other network to alert a monitoring station as well as possibly allow for communicating with the individual. The system may be worn, secured, and/or locked on the driver's leg(s), ankle(s) and/or wrist(s).

To provide additional detail, let us consider how one could determine when a person is driving a vehicle using the proposed wearable system on the ankle of a person. Using a GPS module, the system may determine the speed of the foot, which the same as the vehicle speed if the person is in the car, relative to ground. If the speed is below a certain threshold, say 10 MPH for a given period of time, one could with reasonable accuracy confirm that the person is not driving a vehicle on a road. If the speed goes above a certain threshold such as 10 MPH, the system could then start to monitor the motion pattern of the foot.

If the driver accelerates or decelerates in a short period of time using the foot by pushing either on the gas or on the brakes, the foot normally performs a rotation pattern around the horizontal axis, parallel to the ground, of the vehicle or otherwise moves. A motion pattern within a certain range from a previous steady position and/or movement is performed from up to down or down to up. In the process of performing such rotation, an inertial sensor such as an accelerometer, gyro and/or other sensor may be used to capture information to provide data about such motion.

In addition, during the motion of the foot, a tension in the tendon and ligaments around the ankle develops. Such tension can be captured using pressure or piezoelectric sensors strategically located around the foot ankle.

A similar or different sensor could be used to record the motion of the foot as it moves from the gas pedal to the brakes and vice versa. Similar or dissimilar sensor(s) could be used to monitor motion of the arm of a driver relative to a steering wheel.

Data provided by at least one of and preferably an array of sensors possibly including the speed, orientation and/or location data such as provided by a GPS unit may be correlated and evaluated together to determine a likelihood of whether the person wearing the proposed system is driving. For instance, a person is likely driving when evaluating a likelihood that a brake or gas pedal is pushed and the vehicle speed decreases or increases appropriately.

Note that a similar or dissimilar device can be used to monitor people with house arrest conviction, sex offenders, or other individuals. These two functions are implemented with at least some embodiments of the applicant's monitoring device and method.

The array of sensors preferably includes at least one or more sensors selected from a variety of sensors such as pressure sensors, piezoelectric electric sensors, accelerometer sensors, alcohol sensors, GPS units, etc. Note that a single sensor such as some accelerometers may be sufficient to identify if an individual is a driver. However, to improve the robustness of the decision for many embodiments, and reduce false identifications, multiple sensors may be used together. Information or data provided by the sensors may be converted to digital information and/or evaluated by a data acquisition system. To remove unwanted noise or disturbances, signal preprocessing may be used. Signal amplification may also be used for low level signals. After processing the information or data provided by the sensors, an inference engine or logic device such as one or more processors may be utilized to determine if the person wearing the device is driving or doing some other prohibited activity. Upon statistical likely confirmation of driving, the device may send a text message, e-mail and/or other notification to recipient such as a monitoring station and then may also continue to communicate coordinates of the driver to appropriate authorities.

In addition to movement which could also be accounted for by an individual riding as a passenger in a car, at least one sensor may be preferably utilized in at least some preferred embodiments such as a pressure sensor on the ankle. The sensor could provide data which could correlate to the depressing of the accelerator or brakes and the relative speed could then be monitored in conjunction with the periods of acceleration (or negative acceleration, i.e., braking) to determine whether it is likely that the individual was accelerating (at some value . . . positive or negative) during this particular time.

Various sensor types could be attached proximate the ankle or elsewhere which could evaluate the flexion of the tendons, ligaments, muscles of the ankle and/or foot or leg which operate and/or assist in the accelerator or assist in braking. One or more sensors could be located on the arm, hand and/or wrist of the individual's body. This sensor could take the form of accelerometer, gyro, or other sensor and provide data as to whether an individual is turning his or her hands relative to a steering wheel which could also be coordinated with data from the GPS system to see whether right or left turns are being made by a driver. Other sensors could also be utilized in connection with a GPS sensor to assist the processor in reaching a threshold of determining if a likely situation exists with one wearing the device who is not supposed to be driving. If a likely condition exists, a communication such as transmission through a wireless communications network or other system is provided to alert the appropriate authorities.

In many embodiments, motion of the hands and/or feet are correlated with the speed geographic location and/or acceleration of the individual to determine whether or not a high degree of probability that the individual is driving a vehicle.

Accordingly, in accordance with one presently preferred embodiment of the present invention, a preferred monitor and method employs the use of at least one if not a plurality of sensors in an acquisition system which includes at least one processor equipped with a program to evaluate data and provide at least one output such as through a wireless communication system to send a message to any appropriate personnel in an alarm event situation.

The system preferably utilizes Ground Position System (GPS) unit to provide position, acceleration and/or speed data to the processor. At least a one-way, if not two way, communication system is utilized such as Wi-Fi communication or other system to alert a recipient monitoring station. The monitoring station may be able to communicate with the monitored individual from the monitoring station with some embodiments. Sensors are preferably connected to one or more housings on the driver's ankles and/or wrists.

A GPS unit can sense the speed of the foot similar to the speed of person in the car and thus the car relative to ground. If the speed increases to exceed a predetermined limit or other thresholds such as 10 MPH, the system can also be monitoring the motion pattern of the feet and/or wrist. If the driver accelerates or decelerates, the driver is pushing on either the gas or the brakes. In either case, the foot normally rotates around an axis and pressure is applied on or by tendons or muscles that contract and flex for movement. This motion can be evaluated by the sensor and correlated with a corresponding increase or decrease in speed by the processor(s). Furthermore, a similar or different sensor may also be utilized such as to sense a rotation about the axis of the foot. Another sensor could be utilized to provide data relative to the motion of the arm of the driver. The arm, wrist and hand normally rotates about the wheel during turns. The right and left turning of the vehicle could be correlated to the rotation of the wrists with the processor. Other embodiments may monitor arm and foot motions and/or other indications relating a situation where the individual is likely driving.

Those under house arrest could be monitored with similar technology. Some embodiments would include a GPS unit and a processor. If the individual exceeds a predetermined boundary for that individual, an alarm event can be provided. Furthermore, by providing a GPS instead of a radio transceiver which cooperates with another transceiver in the home, once the individual has left the home, those individuals may be tracked until recovered. While a single sensor could be utilized for some applications such as a GPS sensor for someone on house arrest, utilizing multiple sensors in combination together for some applications may be desirable for providing a system which provides a minimal number of incorrect notifications.

BRIEF DESCRIPTION OF THE DRAWINGS

The particular features and advantages of the invention as well as other objects will become apparent from the following description taken in connection with the accompanying drawings in which.

DETAILED DESCRIPTION OF THE DRAWINGS

Figure 1:
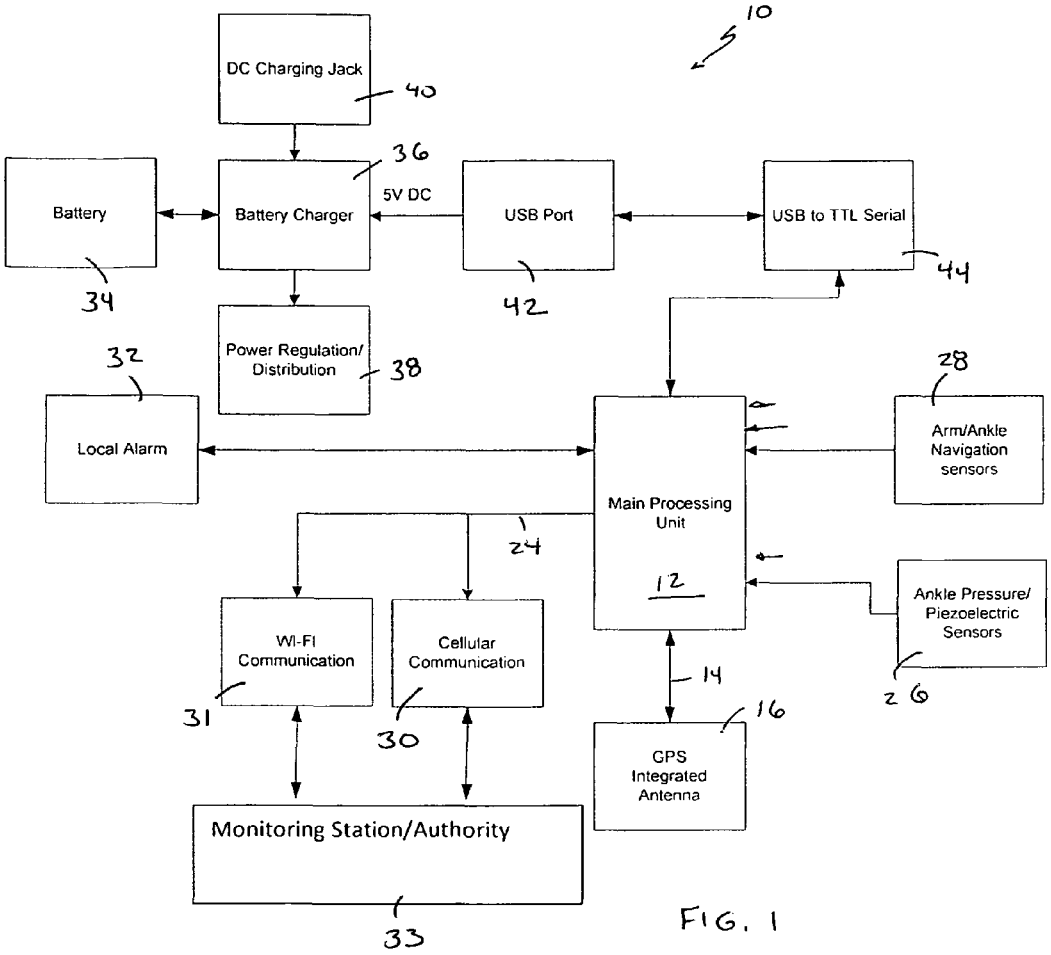
FIG. 1 is a schematic representation of a preferred design of the presently preferred embodiment.

FIG. 1 shows a schematic of a presently preferred monitoring device 10. Specifically, the device 10 illustrated has one or more processor(s) 12 such as a microcontroller, main processor unit or other suitable processor which is provided with an input from at least one sensor such as a global positioning system (GPS) unit input 14 from a GPS unit 16. GPS unit 16 which could be a GPS integrated antenna which provides a signal to a separate process, or the processor 12, or the GPS unit 16 could process at least some data before providing output to processor 12.

Figure 5:
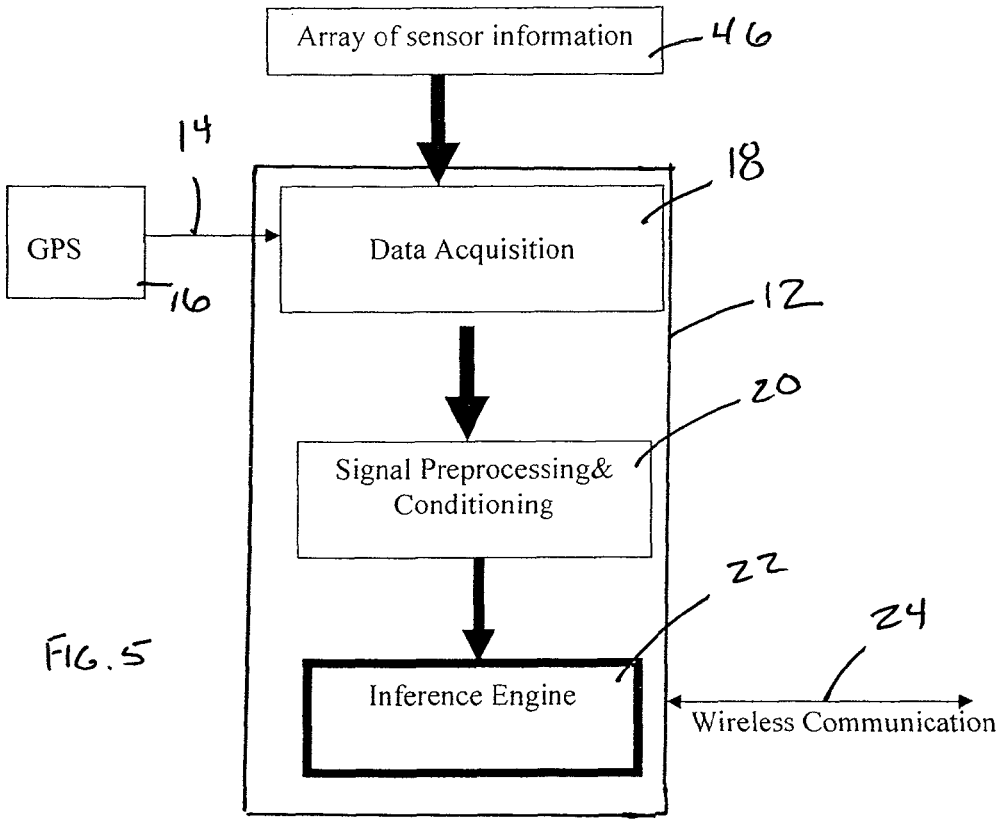
FIG. 5 shows a flow chart showing the process of using the design shown in FIGS. 1 and 2 of the presently preferred embodiment of the present invention.

FIG. 5 provides further detail for a preferred embodiment in that data is acquired by a processor either at the processor 12, at the GPS unit 16, or at the data acquisition location 18. The data, whether analog, digital or other data may be further processed or conditioned at step 20 and then provided to an interference engine 22 where it may be evaluated relative to programmed limits to determine whether or not an alarm condition exists. If an alarm condition does exist, then output is provided preferably originating at the interference engine 22 and/or processor(s) 12 such as through wireless communication 24 to alert appropriate authorities and/or entities as will be described in further detail below. In addition to a GPS unit 16 and a processor 12, one or more optional sensors 26, such as pressure sensor(s), may be utilized. Sensors 26 may be analog or digital in nature. Accelerometer or other sensor such as navigational sensors 28 may also provide input to the processor 12.

A cellular or other communication module 30 is operable to be communicating through a communications network to input and output 24 with the processor 12 under a set of conditions such as determined by a interference engine 22 or other portion of device. Under certain alarm conditions, module 30 may also possibly provide an ability to communicate from the cellular module 30 to the processor 12 and/or to the user under as well (such as if the authorities or other preselected recipient(s) want to immediately tell the individual to stop the vehicle or perform another requirement). Local alarms 32 can be provided such as LEDs, buzzers, etc. to alert the individual of the alarm condition. Module 10 preferably communicates with at least one preselected recipient such as a governmental agency, contractor, monitoring station 33 WiFi connection 31 may be used to communicate with monitoring station 33 and/or others for at least some embodiments and/or other party.

A power supply 34 may provide power. A charging system 36 may be available to recharge the power supply 34 and/or provide power when plugged in. A distribution system 38 maybe utilized. A charger jack 40 may provide power to the power supply 34 directly or indirectly. A USB port 42, serial ports 44 or other components may assist in providing power to processor 12. Power regulation distribution system 38 may also provide power through the processor 12 and/or to the various sensors such as 16, 26, 28 depending on configurations or embodiments selected by the manufacturer. Various sensors 26, 28, referred to as one or more sensors 46 in FIG. 5, may be described and/or thought of similar to those of FIG. 1 in at least some embodiments.

Figure 2:
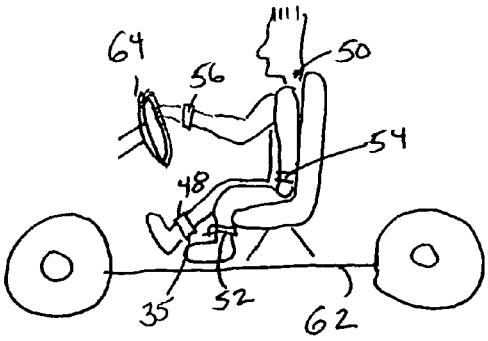
FIG. 2 shows a cross sectional view internal to a vehicle showing a driver using an embodiment of the design shown in FIG. 1.

FIG. 2 shows a first band 35 and housing 48 containing many of the components of the device 10. In fact, in some embodiments a single housing 48 may be utilized. In other embodiments, in addition to first housing 48, additional housings 52, 54, 56 may be utilized such as secured on or to the various extremities and/or appendages of the body 50 so that positions of the driver's wrists, arms and/or hands and ankles, legs and/or feet can at least approximate the positions of the steering wheel and/or brake or accelerator pedals. At least some of the sensors could be evaluated in addition to those components inside of the first housing 48. Specifically, while the first housing may connect to and/or house a GPS unit 16 or other sensor such as 26 or 28, a second and/or other housings 52, 54, 56 may house processor(s) 12. The first housing 48 may, but need not have processor(s) 12 or sensor 16, 28, 26 while the second housing such as 52, 54, 56 could house a pressure sensor 26 and/or accelerometer or other sensor 28 or even GPS unit 16 as will be explained in further detail below.

Figure 3:
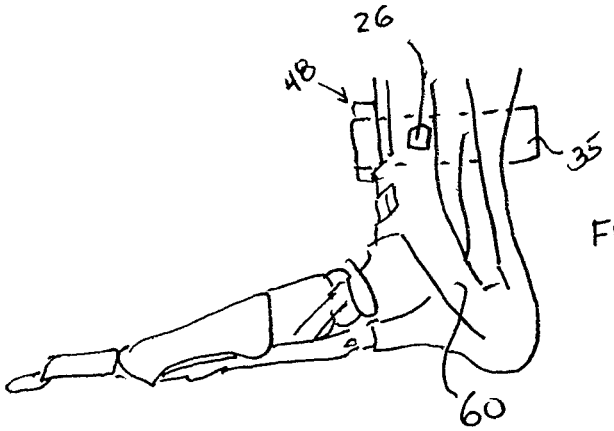
FIG. 3 shows a plan view of a foot with the skin removed showing muscle and skeletal construction with one device shown in FIG. 2 connected slightly above the ankle.
Figure 4:
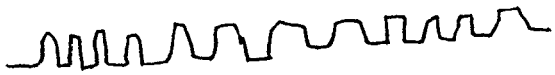
FIG. 4 shows a graph from the pressure sensor shown in FIG. 3.

Pressure sensor 26 is shown in the first housing or second housing 48, 52 Operably coupled to an extremity, in this example foot 58. Pressure sensor 26 could be employed so that as a foot 58 is manipulated such as by accelerating (positively or negatively) over a period of time by the pushing on the gas or the brakes, the foot normally performs a rotational pattern around a horizontal axis 60 such as is taken through ankle. Pressure sensor 26 senses pressure related to foot movement. Horizontal axis 60 is normally somewhat parallel to the ground on which the vehicle 62 is driving, if the user 50 if in fact is driving. In the process of performing such a rotation, a sensor such as the pressure sensor 26 and/or accelerometer 28 as could be utilized may identify the rotation. The sensor could also sense motion of the foot as it is moved from the gas pedal to the brake and/or vice versa. Furthermore, in the application of pressure to a brake or accelerator, tension or compression of the tendons and/or ligaments around the ankle develops. The tension can be measured by pressure sensor 26 which could be a piezoelectric or other sensor strategically located, secured and/or locked to the foot and/or ankle such as is shown in FIG. 3. An actual pressure signal is shown in FIG. 4 by the selective application of acceleration and/or braking with the raised portions of the graph indicating an application of at least one braking and/or use of the accelerator.

The accelerometers, gyros and/or other sensors 28 can be utilized to at least assist in providing data which may correlate to the application brake or accelerator pedals. Similar and/or dissimilar sensors in housings 54, 56 or elsewhere at the wrist can record the movement about the steering wheel 64 which will be explained in further detail below.

For some operations, the use of a GPS unit 16 may be sufficient for some applications for monitoring an individual. Specifically, if the individual is under house arrest, then the processor 12 could be provided with a programmed limit such as geographical limit in which the output 14 of the GPS unit 16 must normally be within. Accordingly, data acquisition 18 has data acquired from the GPS unit 16 which is processed. That information is determined whether or not it correlates to the preset geography limit such as within a property, a yard or physical house itself or within a particular buffer zone so that if the GPS unit is off by a predetermined amount, fewer false reports would be provided. Other features may be incorporated as well such as if the individual 50 having a GPS unit 16 is outside of the predetermined limit such as for a predetermined time and/or a predetermined distance, then the interference engine 22 identifies and/or reports an alarm condition. The alarm condition then triggers a communication 24 such as through a communications network to alert authorities such as with a Wi-Fi e-mail, a text message or other means of communication. Furthermore, local alarm 36 such as a buzzer may alert the user to problems he/she is about to have with authorities. When a communications network is utilized, it could be one way such as from communications module 30 to a predetermined recipient, or two way, which could include receiving incoming transmissions.

A GPS system 16 can also be utilized to provide speed signals or acceleration signals which are derivatives of and related to geographic position data which can be evaluated relative to geographic limits. If the individual 50 is driving or restricted from riding in a car, speeds over a predetermined geographic limit, such as about 10 MPH may create an alarm condition at the interference engine 22. Of course, other speeds (higher or lower) of the person may be utilized as a predetermined limit.

While some embodiments may employ a single sensor use such as a GPS unit 16, other embodiments may coordinate information from at least two sensors as will be explained.

In many embodiments, multiple sensors such as 26, 28 and/or 16 are utilized to evaluate whether an individual is driving. Specifically, the sensor 26 such as a pressure or force sensor can be utilized on the foot and/or ankle and/or the lower leg of an individual 50 to provide an indication evaluated by interference engine 22 relative to a movement limit such as provided in FIGS. 4 and 5 when an individual is depressing either presumably the brake or accelerator with the foot 60. Data from the GPS unit 16 can be evaluated at a similar time to evaluate whether or not a potential vehicle is accelerating or decelerating. By coordinating the two data together, a more accurate determination can be made as to whether or not the individual 50 is likely a driver or a rider.

For instance, if the individual 50 is determined to be pushing with their foot (i.e., within a movement limit) and a sudden decrease in speed occurs, based on a decrease in speed data from the GPS unit 16, it can be determined to likely be a braking situation. If a depression of the foot 60 corresponds with the acceleration data from the GPS unit 16, the increase in speed is likely that a result of the individual 50 stepping on the accelerator. For at least some cars, holding the accelerator in a specific position may be sensed by the sensor 26 to identify a particular speed is being driven. Furthermore, if the individual 50 switches from the accelerator to the brake that may be sensed either by a sensor 26 and/or gyro or accelerometer or other sensor 28. A corresponding increase or decrease in speed can be evaluated by the processor 12 based on data from the GPS unit 16.

For some embodiments, it may be desirable to provide sensor 26 on both feet such as with housings 48, 52. This may keep people from trying to drive while the wrong foot. Other embodiments may not need a housing on both feet 60, but instead the right foot may be utilized. Furthermore, utilizing a third and/or fourth housing 54, 56 near the wrists or hands of the user can be monitored such as with accelerometers, gyros or other sensors 28 which interference engine 22 evaluating whether or not a wheel is being turned relative to a move event limit of expected hand motion such as a steering wheel which can be evaluated with the data from the GPS unit 16 to evaluate whether or not an individual is turning based on a direction change or other criteria. For instance, at a particular speed, such as 10 MPH, sensor on the GPS unit 16 and a quarter turn of the wheel 64 can be estimated that the direction and/or future position of the GPS unit can be evaluated if an individual were in the car. The individual will be right of their initial position. Once again, at least one housing 54 and/or 56 can be utilized. If only one is utilized, it may be that some drivers selectively utilize a hand they believe it is not being monitored. Of course, embodiments may have some or all of four housings 48, 52, 54, 56. Furthermore, other embodiments may have other sensors configured to assist in monitoring a particular person 50 whether it be for in house arrest, driving prohibition, and/or other rationale for monitoring an individual.

Some embodiments may or may not have GPS unit(s) 16 provided as sensors. Instead, some embodiments may have at least two sensors such as sensors 26, 28 which provide data to at least one processor 12 for evaluation by the interference engine 22 or other component whereby movement of the individual relative to at least one movement limit(s) is evaluated. Specifically, it may be possible to monitor the movement of the hands in coordination with movement of the feet of the individual at least in some embodiments. Of course, some embodiments may include a GPS unit 12 or other sensors 26, 28 in the way of sensors. Furthermore, some of the sensors may not necessarily be secured to the body of the individual but could just be positioned to monitor the movement of the body such as an optical eye infrared sensor or other sensor as may be known by those of ordinary skill in the art.

Figure 6:
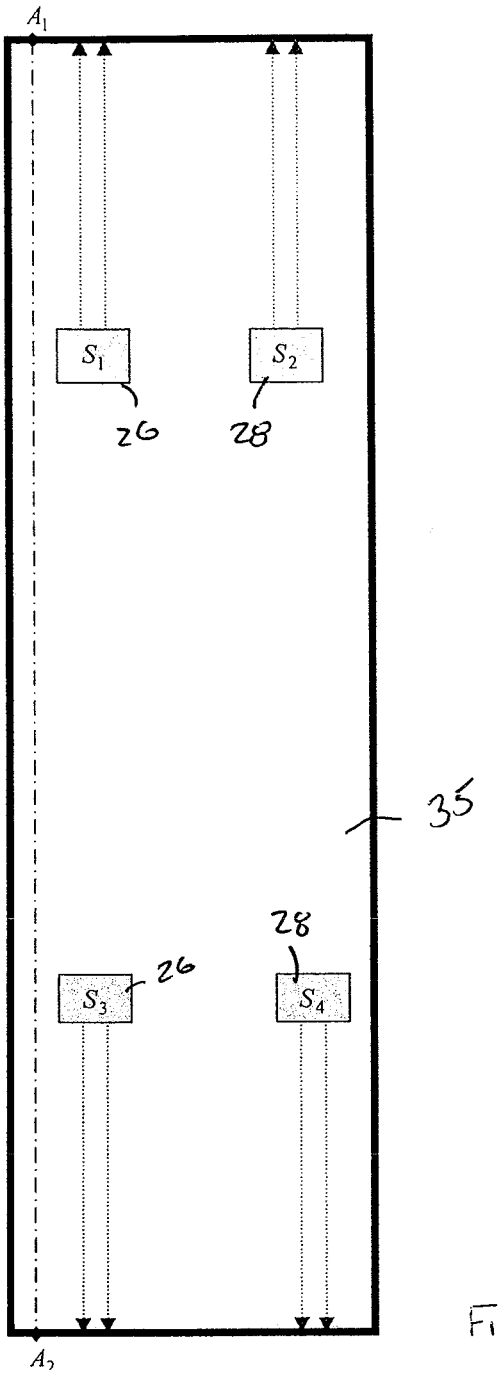
FIG. 6 is a schematic view of a band used with the preferred embodiments of FIGS. 1-6.

FIG. 6 shows a band 35 with at least one, if not a plurality of sensors such as sensor 26 and/or 28 which in this embodiment are connected to band 35 which could then provide a signal on to the housing 48 such as is shown in FIG. 3 and/or otherwise. Band 35 could be integral to or a separate attached component relative to the housing 48 for use by the processing unit 12 which comprise one or more processors. Sensors 26, 28 could be pressure sensors, force sensors, or other sensors such as alcohol sensors to monitor alcohol levels for some embodiments. Other embodiments may include other sensors for various purposes. The band 35 may include the technology of providing a voltage across $A_1$ and $A_2$ as well as sensing a resistance across $A_1$ and $A_2$. The voltage across $A_1$ and $A_2$ and the resistance across $A_1$ and $A_2$ is zero when intact. The processor 12 can thus ascertain that the band has not been severed. However, if the band is severed, cut, opened or the circuit between $A_1$ and $A_2$ is otherwise broken, the resistance between $A_1$ and $A_2$ would potentially jump to an infinite value or at least significantly higher depending on if there was any connection left. An alarm could then be generated and sent by processor 12 through either cellular or WiFi communications 30, 31 to the monitoring station 33 or other appropriate personnel.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

The invention claimed is:

1. A real time monitoring device comprising:

at least one sensor securely connected to a body of an individual, said at least one sensor providing inputs to a processor, said two sensors operating independently of one another, a first sensor outputting data relative to a speed of the individual and a second sensor outputting physical movement of an extremity of the individual as the inputs to the processor; and wherein the processor evaluates the data in real time relative to a programmed limit of a combined speed limit and a movement limit, and if the data is at least one of outside the speed and movement limit, providing at least one output identifying an alarm condition; said monitoring device providing a communication through a wireless communication network upon occurrence of the alarm condition alerting of the alarm condition to a preselected recipient.

2. The monitoring device of claim 1 further comprising a geographic limit corresponding to a physical boundary selected from the group of a property and a house and the programmed limit includes the geographic limit with the first sensor providing a geographic location output evaluated by the processor.

3. The monitoring device of claim 1 wherein at least first and second sensors and processor are located in a first housing secured to the body of the individual.

4. The monitoring device of claim 3 wherein the first housing is secured directly to an extremity of the individual, said extremity is selected from the group of an arm, a wrist, a leg, an ankle and a foot.

5. The monitoring device of claim 1 wherein the second sensor provides data relative to the movement of the individual and the data is evaluated relative to at least to movement limits and the first sensor is a GPS sensor.

6. The monitoring device of claim 4 wherein the second sensor further comprises at least one sensor operably coupled to the extremity, said sensor sensing pressure related to foot movement.

7. The monitoring device of claim 4 wherein the second sensor further comprises at least one motion sensor operably coupled to the extremity, said at least one motion sensor sensing movement related to foot movement.

8. The monitoring device of claim 7 wherein the second sensor is selected from the group of a gyro and an accelerometer.

9. The monitoring device of claim 1 further comprising at least first and second housings with the first housing retaining the processor and the second housing retaining at least one of the at least two sensors.

10. The monitoring device of claim 1 wherein the first sensor further comprises a Global Positioning System (GPS) unit providing at least one of location, speed and acceleration data and the second sensor providing movement data related to at least one of the individuals extremities.

11. The monitoring device of claim 10 wherein the data meets at least two criteria selected from the group of at least one of outside the geographic limit and within the movement limit, providing at least one output identifying an alarm condition.

12. The monitoring device of claim 11 wherein a foot movement relates to one of depressing and releasing one of an accelerator pedal and a brake pedal by the second sensor, and a corresponding acceleration value is sensed by the first sensor.

13. The monitoring device of claim 11 wherein the movement limit is related to hand movement of the individual.

14. The monitoring device of claim 13 wherein the hand movement relates to turning of a vehicle steering wheel and the direction of the individual has a corresponding change.

15. The monitoring device of claim 1 wherein the communication is selected from the group of a text message and an e-mail.

16. The monitoring device of claim 1 wherein the preselected recipient is a governmental agency.

17. The monitoring device of claim 1 wherein the at least one sensor is locked to the body of the individual.

18. A monitoring device comprising at least two independently operating sensors configured to monitor motion relative to a body of an individual, with a second sensors providing data relative to physical movement of an extremity of the individual as input to a processor; and a first sensor providing data from a global positioning sensor unit to the processor;

said processor evaluates the input and data in real time relative to at least two programmed movement limits, and if the data and input is at least one of outside a speed or and inside of the movement limit, providing at least one output identifying an alarm conditions;

said monitoring device providing a communication through a wireless communication network upon occurrence of the alarm condition to a preselected recipient.

19. A method of monitoring an individual comprising the steps of:

providing at least two sensors securely connected to a body of an individual, said at least ene two sensors providing inputs to a processor, said first sensor outputting data relative to at least one of a geographic position of the individual and the second sensor outputting data relative to movement of an extremity of the individual;

the processor evaluating the data in real time relative to a programmed limit having a geographic limit and a speed limit, a movement limit, and if the data is outside the geographic and speed limits and within the movement limit, providing at least one output identifying an alarm condition; and then providing a communication through a wireless communication network upon occurrence of the alarm condition alerting of the alarm condition to a preselected recipient.

* * * * *